US006921071B2

(12) United States Patent
Stahl

(10) Patent No.: US 6,921,071 B2
(45) Date of Patent: Jul. 26, 2005

(54) MULTI-PLAY JAR TICKETS

(75) Inventor: Whiteford J. Stahl, Losantville, IN (US)

(73) Assignee: Muncie Novelty Company, Inc., Muncie, IN (US)

( * ) Notice: Subject to any disclaimer, the term of this patent is extended or adjusted under 35 U.S.C. 154(b) by 92 days.

(21) Appl. No.: 10/686,831

(22) Filed: Oct. 16, 2003

(65) Prior Publication Data

US 2005/0082748 A1 Apr. 21, 2005

(51) Int. Cl.[7] ..... A63F 3/06; A63F 3/08

(52) U.S. Cl. ..... 273/139; 273/138.1; 283/901; 283/903

(58) Field of Search ..... 273/139, 138.1, 273/269, 274; 283/901, 903

(56) References Cited

U.S. PATENT DOCUMENTS 4,099,721 A * 7/1978 Logander ..... 273/139
4,270,774 A * 6/1981 Barnes ..... 283/62
5,046,737 A 9/1991 Fienberg
5,106,090 A 4/1992 Greenwood
5,253,899 A 10/1993 Greenwood
5,286,062 A 2/1994 Greenwood et al.
5,407,200 A 4/1995 Salabak
5,921,547 A 7/1999 Wilner

* cited by examiner

*Primary Examiner*—Benjamin Layno
(74) *Attorney, Agent, or Firm*—Barnes & Thornburg LLP

(57) ABSTRACT

A play piece for a game of chance has a game portion and an identification portion. Multiple play combinations are printed on the game portion. The play piece can then be folded to conceal the multiple play combinations, and sealed in some fashion. Multiple play pieces may be manufactured concurrently by printing several on a single piece of paper. The pieces are folded by a folder and separated by a separator.

25 Claims, 3 Drawing Sheets

MULTI-PLAY JAR TICKETS

BACKGROUND OF THE INVENTION

The present invention relates to a game of chance, and particularly to a game of chance that uses tickets or play pieces purchased by game players. More particularly, the present invention relates to a jar ticket for use in a game of chance, the jar ticket having a concealed play combination.

SUMMARY OF THE INVENTION

The present invention relates to one or more of the following features, elements or combinations thereof. A play piece has a game portion and an identification portion. Multiple play combinations are printed on the game portion. The play piece can then be folded to conceal the multiple play combinations, and sealed in some fashion. Banding, glue, crimping, perforating, or any other manner of sealing the play piece may be used.

Multiple play pieces may be manufactured concurrently by printing several on a single piece of paper. The pieces are folded by a folder and separated by a separator. The play pieces can be sealed.

Additional features of the disclosure will become apparent to those skilled in the art upon consideration of the following detailed description of preferred embodiments exemplifying the best mode of carrying out the invention as presently perceived.

BRIEF DESCRIPTION OF THE DRAWINGS

The detailed description particularly refers to the accompanying figures in which.

DETAILED DESCRIPTION OF THE DRAWINGS

In a game of chance that uses tickets commonly known as "jar tickets", it is common for a game player to purchase such a jar ticket that has a concealed numeric or alphanumeric play combination. A prior art jar ticket can be seen in FIG. 3. In one embodiment in the game of chance, ajar ticket purchaser reveals his play combination to determine whether it is one of the predetermined winning combinations.

Figure 4:
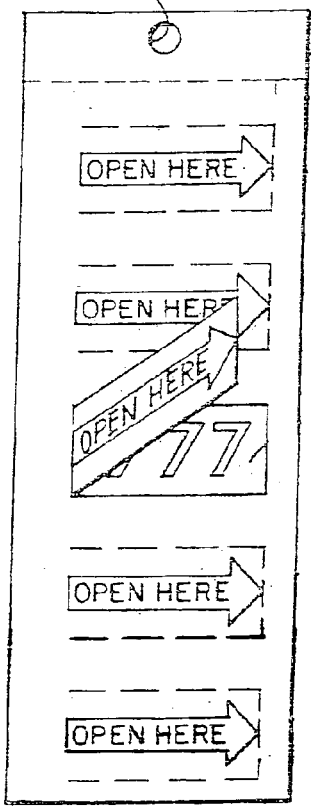
FIG. 4 shows a prior art play piece having windows that can be opened to expose multiple play combinations.
Figure 3:
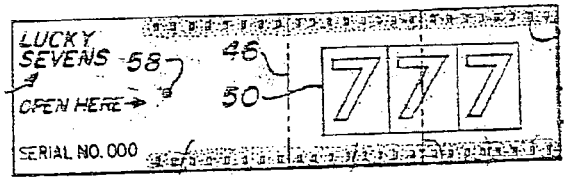
PRIOR ART Fig. 3
FIG. 3 shows a prior art play piece having a single play combination.
Figure 2:
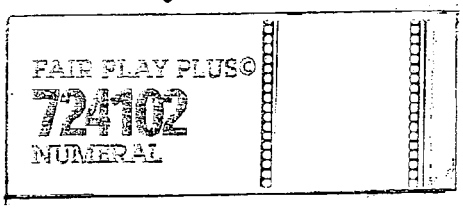
PRIOR ART Fig. 2
FIG. 2 shows a play piece that has been folded and banded.
Figure 5:
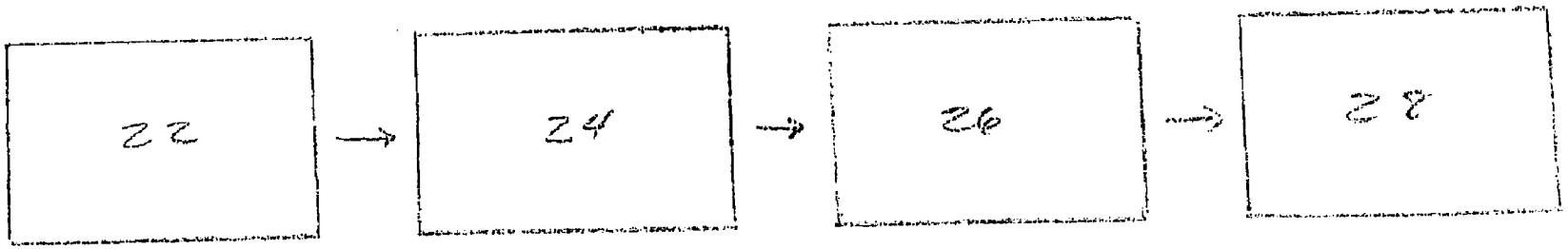
FIG. 5 diagrammatically shows a method of manufacturing play pieces.

In the past, however, if multiple plays were desired, multiple jar tickets such as that shown in FIG. 3 would need to be purchased. In the alternative, the configuration such as that shown in the prior art embodiment in FIG. 4 could be used, wherein multiple windows exist on a single ticket, the windows being opened to reveal additional play combinations. However, such an embodiment is difficult to manufacture and requires several steps in its formation.

According to the present disclosure, a single play piece 10 includes a game portion 12 and an identification portion 14 on opposite ends of an elongated strip. A serial number 16 may be printed on identification portion 14 so that game orchestrators can track the legitimate sales of play pieces 10.

A plurality of play combinations 18 are printed sequentially along game portion 12 of play piece 10. Illustratively, each play combination 18 is a distinct number, alpha numeric combination, or image. An image may be an icon, a decorative number, picture, or any other symbol that could be used to designate a certain prize. The icon may be in multiple colors, and certain colors may be used to designate a prize.

As used herein, the terms "sequential," "sequentially," or "in sequence" refer to the manner in which play combinations 18 are arranged on game portion 12 of play piece 10. Such a sequential arrangement positions play combinations 18 at differing locations along the length of the elongated play piece 10. Play combinations 18 are not provided at the same length-wise position along elongated play piece 10.

Illustratively, play piece 10 is an elongated piece of paper having printing and possibly decorative designs thereon. However, it should be understood that play piece 10 may be constructed of other materials such as plastic or any other substrate that is capable of being imprinted. Thus, the word "paper" as it is used herein is intended to refer to paper-like materials formed as sheets or elongated strips that can be used as play pieces.

Figure 1:
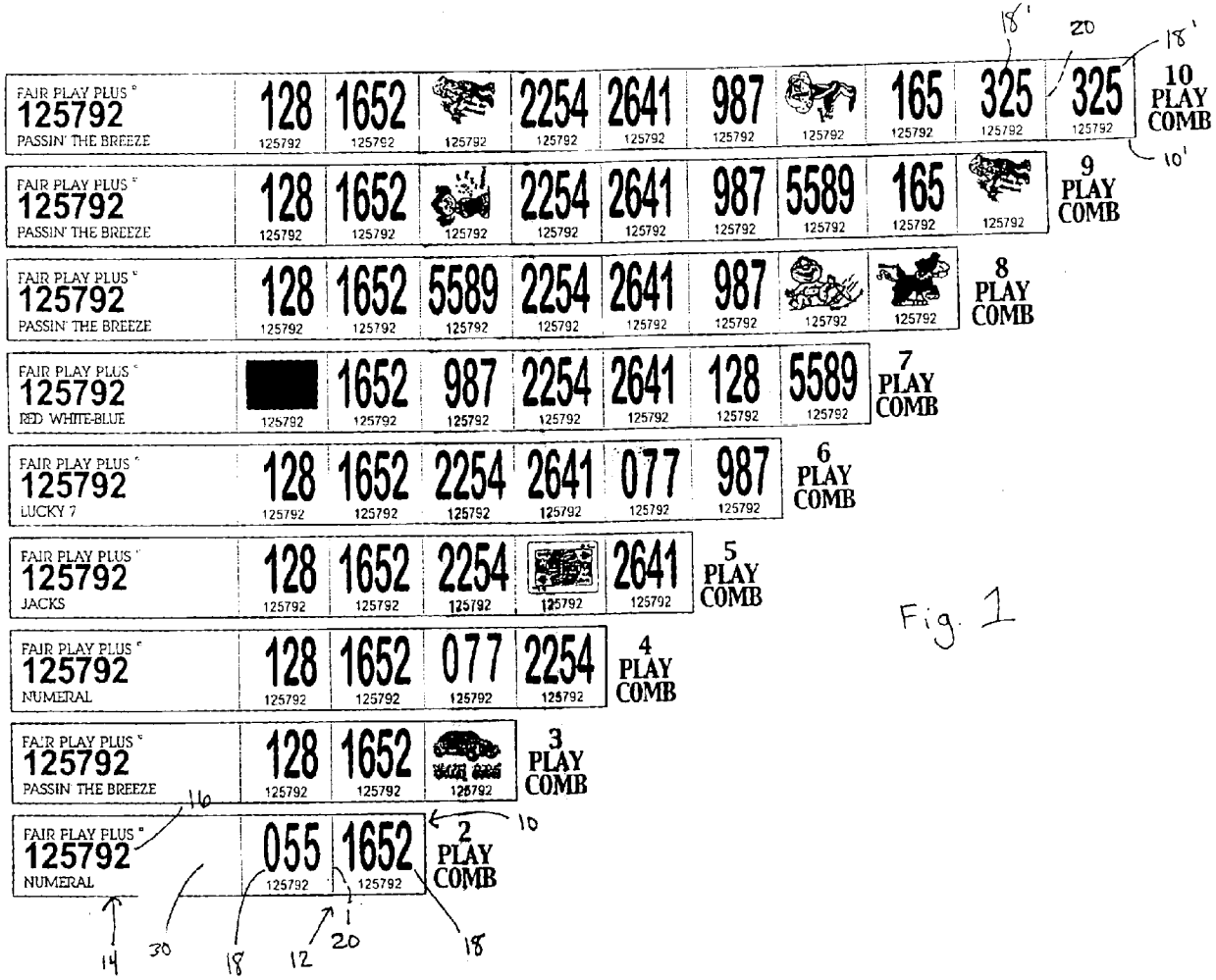
FIG. 1 shows a number of embodiments of play pieces that permit multi-play in a game of chance.

In the illustrative embodiment, the play piece 10 located at the bottom of FIG. 1 has two play combinations 18 printed thereon. However, it should be understood that any number of play combinations 18 may be printed on a single play piece 10, as is demonstrated by the other embodiments as shown in FIG. 1. For example, a play piece 10' may include 10 or more play combinations 18'.

Illustratively, play piece 10 is manufactured in the following manner. Play piece 10 is printed with serial number 16 and play combinations 18 sequentially positioned in game portion 12. Play combinations 18 are illustratively printed in sequence on the play piece 10 such that each play combination 18 is spaced at a different distance from serial number 16 than any other play combination, as can be seen in FIG. 1.

In one embodiment, several play pieces 10 may be printed together on the same sheet of paper. After such play pieces are printed by a printer 22 onto a sheet of paper, the paper is fed into a folder 24. Such a folder 24 illustratively folds play pieces 10 along illustrative fold lines 20 to conceal play combinations 18, although other folds are within the scope of the disclosure. For example, play pieces 10 could be folded such that two or more play combinations 18 are disposed between each fold line 20, or such that play pieces 10 are folded along play combinations 18. Fold lines 20 may not actually be visible lines, but are rather illustrative indications of where the play piece 10 would be folded. Illustratively, the folds are approximately one inch apart.

Illustratively, play pieces 10 are configured such that an unused portion 30 is disposed between the game portion 12 and the identification portion 14. Such an unused portion 30 is illustratively approximately one inch in length, and helps to prevent a game player from peeking under the folded portion to unfairly see the play combinations 18 prior to purchase. It should be understood that graphics, indicia, or other print may extend into unused portion 30, however, such an unused portion 30 illustratively does not have play combinations 18 imprinted thereon.

In the embodiment where a plurality of play pieces 10 is printed on a single piece of paper, play pieces 10 are illustratively slit by folder 24. In embodiments where play pieces 10 are printed individually and not as a plurality on a single piece of paper, folder 24 does not slit the play pieces.

Play pieces are next illustratively delivered to a separator 26 which separates the play pieces 10 into rows spaced approximately 3" apart. Finally, play pieces 10 are presented to a bander 28, which places a band around each play piece 10, the band being eventually broken by the game player. It should be understood, however, that although the illustrative embodiment utilizes a bander, other methods of sealing play piece 10 are within the scope of the disclosure, and such a device may be substituted for the bander. For example, play piece 10 may be crimped, perforated, glued, or bound in any other method that functions to conceal game portion 12 until it is desired to reveal the game portion 12 during play. As a further alternative, a plurality of play pieces 10 may be bound together, either with a bander or by other means as described.

A folder 24 may illustratively be configured to perform the following steps. For illustration purposes, a sheet of paper measuring 4.5" by 5" is presented to the folder. The folder folds the sheet twice at 1" fold increments from one end. The number of folds may be greater of less depending on the length of the paper. The paper is then slit into 5 rows of 1" wide folded product (play pieces 10). One end (the game portion 12) of the product is folded, the other (identification portion 14) is not, and the identification number 16 is exposed. It should be understood that other dimensions of sheets of paper are within the scope of the disclosure, and additional folds and/or additional folded products can be provided by using sheets of paper with larger dimensions. The folder 24 may also be configured to count and verify the products at the feed and delivery ends, as well as at other locations in the process.

A separator 26 may be configured to perform the following steps. The separator illustratively separates five rows (across) of shingle-fed or vertically stacked play pieces 10 both lengthwise and widthwise. The rows are illustratively approximately 3 inches apart. The separator illustratively delivers five rows of individual play pieces to a bander 28 simultaneously. Dimensions of the play pieces would illustratively be 1" wide by 2.5" long. The separator 26 would illustratively be configured to maintain the fold of the play piece during the process. The separator 26 would also illustratively count and verify at the feed and delivery ends, and at possibly more locations.

A bander 28 may be configured to perform the following steps. Five rows of game pieces would be fed into the bander, and the bander would apply, via adhesive, a 0.750" band that is fed and cut from a roll of tape to each game piece. Game pieces could then be collected by the bander and delivered in five stations approximately 3" apart from each other. The tickets could be delivered single, or in bundles of 2–10 or more.

While the above-described process is used to illustrate the manufacture of play piece 10, it should be understood that other methods of manufacture, binding, and presenting play pieces 10 are within the scope of the disclosure. For example, play pieces 10 may be printed individually after being sized or cut to the desired configuration. Play pieces 10 may be attached to a game book. Play pieces 10 may not be presented to a bander. Processes, such as folding, may be performed by hand where possible.

Illustratively, each play piece 10 is bound together in some fashion so that play combinations 18 remain concealed until a game player opens the game portion 12 of the play piece 10 to reveal play combinations 18. Play pieces 10 may be bound in any fashion known in the art, including banding, gluing, crimping, or any other method that functions to conceal game portion 12 until it is desired to reveal the game portion during play. Illustratively, a second play combination cannot be revealed until the first play combination is revealed. When it is desired to reveal such play combinations 18, play piece 10 is unfolded along fold line 20, either breaking the band or the tacked, glued, or crimped seal, thereby revealing play combinations 18.

Illustratively, when more than two play combinations 18 are printed on a play piece 10, for example when 10 play combinations 18' are printed on play piece 10', additional folds or fold lines 20' separate the play combinations 18'. As illustrated, a single fold line 20, 20' exists between each play combination 18, 18'. However, it is within the scope of the disclosure to print more than one play combination 18, 18' in sequence between each fold line 20, 20'. Illustratively, the serial number 16 is printed again in a smaller font underneath each play combination 18, 18'.

In another embodiment of the present disclosure, a method is disclosed for forming a game piece for a game of chance. A method includes the steps of printing a plurality of play combinations on play piece 10, and folding play piece 10 such that the plurality of play combinations is concealed.

It should be understood that multiple play pieces 10 may also be bound together to be sold as a group. For example, a plurality of play pieces 10, each having a plurality of play combinations 18 printed thereon, may be sold in a banded stack. Such a stack may have play pieces 10 individually folded, or it may have a plurality of play pieces 10 folded together.

While the disclosure is susceptible to various modifications and alternative forms, specific exemplary embodiments thereof have been shown by way of example in the drawings and have herein been described in detail. It should be understood, however, that there is no intent to limit the disclosure to the particular forms disclosed, but on the contrary, the intention is to cover all modifications, equivalents, and alternatives falling within the spirit and scope of the disclosure as defined by the appended claims.

A plurality of advantages arises from the various features of the present disclosure. It will be noted that alternative embodiments of various components of the disclosure may not include all of the features described yet still benefit from at least some of the advantages of such features. Those of ordinary skill in the art may readily devise their own implementations of a jar ticket that incorporates one or more of the features of the present disclosure and falls within the spirit and scope of the disclosure.

What is claimed is:

1. A game of chance comprising:

an elongated play piece having a game portion end and an identification portion end, a serial number printed on the identification portion end, a first play combination printed on the game portion end at a first distance from the serial number, and a second play combination printed on the game portion end at a second distance from the serial number, the second distance being greater than the first distance, a fold is located between each play combination wherein the play piece is folded to form an unused position wherein the serial number is revealed and the first and second play combinations are concealed, and the play piece can be unfolded to first reveal the first play combination and then the second play combination.

2. The game of chance of claim 1, wherein the play piece is a single ply material.

3. The game of chance of claim 1, further comprising a third play combination printed on the game portion, the third combination being separated from the serial number by a third distance that is greater than the second distance.

4. The game of chance of claim 1, wherein the play piece is sealed to prevent the accidental revealing of the game portion.

5. The game of chance of claim 4, wherein the play piece is sealed with a band.

6. The game of chance of claim 4, wherein the play piece is sealed with crimping.

7. The game of chance of claim 4, wherein the play piece is sealed with glue.

8. A game of chance comprising:

a play piece having a game portion and an identification portion, a serial number printed on the identification portion, a concealable first play combination printed on the game portion, and a concealable second play combination printed on the game portion, the first play combination being concealed when the second play combination is concealed, wherein the play piece is configured such that the serial number is revealed and the first and second play combinations are concealed when the first and second play combinations are folded over each other and the first and second play combinations are revealed by opening the play piece.

9. The game of chance of claim 8, wherein the play piece is a single piece of paper.

10. The game of chance of claim 8, further comprising a third play combination printed on the game portion, the third combination being concealed when the first, second and third play combinations are folded over each other and the third combination being revealed when the play piece is opened.

11. The game of chance of claim 8, wherein the play piece is sealed to prevent the accidental revealing of the game portion.

12. The game of chance of claim 8, wherein the game portion is revealed when the play piece is used.

13. The game of chance of claim 12, wherein the play piece is unfolded during use to reveal the game portion.

14. The game of chance of claim 8, further comprising an unused portion disposed between the serial number and the first play combination.

15. The game of chance of claim 14, wherein the unused portion is revealed by unfolding the play piece by a single fold.

16. A game of chance comprising:

a play piece having a game portion and an identification portion, a serial number printed on the identification portion, a first play combination printed on the game portion and revealable during play, and a second play combination printed on the game portion, the second play combination being separated from the first play combination by a fold located between the first and second play combinations and being separately revealable from the first play combination.

17. The game of chance of claim 16, wherein the serial number is further printed below each play combination.

18. A method of forming a play piece for a game of chance, the method comprising the steps of:

printing a plurality of play combinations on the play piece, and folding the play piece such that the plurality of play combinations are folded over one another.

19. The method of claim 18, wherein the play piece is folded along a line disposed between two of the plurality of printed play combinations.

20. The method of claim 18, further comprising the step of sealing the folded play piece in the folded position.

21. The method of claim 20, wherein the sealing step comprises one of banding, crimping, or gluing the play piece.

22. The method of claim 18, further comprising the step of printing a serial number under each play combination.

23. A game of chance comprising:

an elongated play piece having a game portion end, a first play combination printed on the game portion end, and a second play combination printed on the game portion end apart from the first play combination, wherein the first and second play combinations are folder over one another to form an unused position wherein the first and second play combinations are concealed.

24. The game of chance of claim 23 wherein the play piece can be unfolded to reveal the first and second play combinations.

25. The game of chance of claim 24 wherein the play piece is configured to first reveal the first play combination and to next reveal the second play combination.

* * * * *